US008683654B2

(12) United States Patent
Chen

(10) Patent No.: US 8,683,654 B2
(45) Date of Patent: Apr. 1, 2014

(54) ADJUSTABLE TORQUE HINGE

(75) Inventor: Waterson Chen, Taichung (TW)

(73) Assignee: Waterson Corp., Douliou, Yunlin County (TW)

( * ) Notice: Subject to any disclaimer, the term of this patent is extended or adjusted under 35 U.S.C. 154(b) by 0 days.

(21) Appl. No.: 13/814,366

(22) PCT Filed: Oct. 29, 2010

(86) PCT No.: PCT/US2010/054696

§ 371 (c)(1),
(2), (4) Date: Apr. 8, 2013

(87) PCT Pub. No.: WO2012/018361

PCT Pub. Date: Feb. 9, 2012

(65) Prior Publication Data

US 2013/0205543 A1 Aug. 15, 2013

(30) Foreign Application Priority Data

Aug. 5, 2010 (TW) ..... 99126071 A
Sep. 7, 2010 (CN) ..... 2010 1 0273481

(51) Int. Cl.
*E05F 1/08* (2006.01)

(52) U.S. Cl.
USPC ..... 16/301; 16/50; 16/298

(58) Field of Classification Search
USPC ..... 16/298–301, 50, 54, 55, 304, 307, 308
See application file for complete search history.

(56) References Cited

U.S. PATENT DOCUMENTS

| | | | | |
|---|---|---|---|---|
| 3,965,533 | A * | 6/1976 | Frohlich | 16/300 |
| 4,073,038 | A | 2/1978 | Curry et al. | |
| 4,419,788 | A * | 12/1983 | Prout | 16/300 |
| 4,583,262 | A * | 4/1986 | Werner | 16/300 |
| 4,756,051 | A * | 7/1988 | Shy | 16/50 |
| 5,048,155 | A * | 9/1991 | Hwang | 16/301 |
| 5,572,768 | A | 11/1996 | Daul | |
| 5,715,574 | A | 2/1998 | Schall | |
| 6,618,902 | B2 | 9/2003 | Wu | |
| 6,732,408 | B2 * | 5/2004 | Wu | 16/298 |
| 7,210,199 | B2 | 5/2007 | Clark | |
| 8,245,353 | B2 * | 8/2012 | Homner et al. | 16/299 |
| 2011/0072618 | A1 * | 3/2011 | Chen | 16/303 |

* cited by examiner

*Primary Examiner* — William Miller
(74) *Attorney, Agent, or Firm* — Stroock & Stroock & Lavan LLP

(57) ABSTRACT

An adjustable torque hinge includes a set hinge, a torque providing unit and a torque adjusting unit. The set hinge unit couples a first and second wing plate with a pivot pin. The first and second wing plates forms a pin joint with a first sleeve and second sleeve. The torque providing unit includes a torque spring to provide turn back recovery. A torque adjusting unit has a torque adjustment member. The first sleeve includes a first cam, and the torque adjustment member includes a second cam which couples with the first cam to drive the torque adjustment member to the torque spring. Conversion between the first and second sleeves enables the bearing hinge to be used in both directions, accumulating force both in normal and reverse directions to adjust the torque force for opening and closing operations.

5 Claims, 7 Drawing Sheets

ADJUSTABLE TORQUE HINGE

CROSS-REFERENCE TO RELATED APPLICATIONS

This application is the National Stage of International Application No. PCT/US2010/054696, filed on Oct. 29, 2010, which claims the benefit of Taiwanese Patent Application Ser. No. 099126071, filed on Aug. 5, 2010 in the name of the same applicant, and which also claims the benefit of the People's Republic of China (PRC) Patent Application Ser. No. 201010273481.5, filed on Sep. 7, 2010 in the name of the same applicant. The contents of all of these applications are incorporated into the present application by reference.

FIELD

The present invention relates to a hinge type device. and, more particularly, an adjustable torque hinge used for pivotal rotation purposes.

BACKGROUND

Most pivot-rotating objects generally apply a hinge device mounted on a fixed object, wherein the object rotates to perform opening and closing operations, for example: door panels, windows, cabinet doors, etc. Referring to FIG. 1 of a well-known recovery torque hinge device 10, said device includes a first wing plate 11, a second wing plate 12, a washer 13, a pivot 14, two set screws 15, a torque spring 16, an adjusting sleeve 17 and an adjusting pin 18; the first and second wing plates 11, 12 are respectively employed on the door panel and frame (not shown), and the sides of said wing plates include counterpart pin joint sleeve members 111, 121. The sleeve members 111, 121 are interactively superimposed, wherein a washer 13 is interposed between the sleeve members for pivotal rotation. The pivot 14 is inserted inside the pin joint sleeve members 111, 121, whereby the first and second wing plate 11, 12 match to form a pin joint. The two set screws 15 are threadedly employed at on the outside peripheral surface of the pin joint sleeve member 111 of the first wing plate 11, and thereby pivot 14 is tightly screwed and fixed, the pivot 14 having a bearing rod 141 that extends from the bottom of pivot 14. The adjusting sleeve 17 can rotatably sleeve inside the pin joint sleeve member 121 of the second wing plate 12; a dent area at the center includes a bearing hole 171 to enable the bearing rod 141 to sleeve inside, and a torque spring 16 is set on the bearing rod 141, wherein the top side is mounted and fixed on the pivot 14 with the bottom side mounted and fixed on the adjusting sleeve 17 so that torque spring 16 can operate on the first and second wing plates 11, 12. An expected amount of torque force is created by the hinge device 10 to automatically close the door. Moreover a slide slot 122 is located in the circumferential direction at the bottom of the pin joint sleeve member 121 of the second wing plate 12, and the outer periphery of the adjusting sleeve 17 includes a number of insert holes 172 at the dent locations of the corresponding slide slot 122. The adjusting pin 18 can be inserted into one of the insert holes 172 at the desired position through the slide slot 122. After the adjusting pin 18 slides along with rotation of the adjusting sleeve 17 to abut against the inner wall of the slide slot 122, the torque spring 16 begins to twist and store energy. As a result, the user can insert the adjusting pin 18 into different insert holes 172 to adjust the torque spring 16 to produce different values of torque force.

The previously described hinge device 10 features a recovering torque effect which still, however, has disadvantages.

The well-known hinge device 10 employs an adjusting pin 18 to first block the inner wall of the slide slot 122 before the adjusting sleeve 17 begins to twist the torque spring 16 to produce torque. However, the slide slot 122 can be opened with only just a small distance which results in limited adjusting of torque size. Moreover, the adjusting of the hinge device 10 employs the inserting of the adjusting pin 18 into different positions of the insert holes 172. This type of inset adjustment operation consumes much time and shows to be inconvenient.

SUMMARY

An objective of various embodiments of the invention herein is to provide an adjustable torque hinge which accumulates pressure in both normal and reverse directions to adjust the torque force in a convenient manner.

With these embodiments, there is provided an adjustable torque hinge set comprising a hinge unit, a torque providing unit and a torque adjusting unit. The hinge unit includes a first wing plate, a second wing plate, a first sleeve and a second sleeve. The first wing plate includes a set of first sleeve knuckles, and the second wing plate includes a set of second sleeve knuckles, in which the second sleeve knuckles couple with the first sleeve knuckles. A movable connection is formed by the combined first and second sleeves, and a first cam is included with the first sleeve. The torque providing unit includes a movable pivot located between the first and second sleeve knuckles, and an overlay torque spring on the pivot. The outer periphery of the pivot is connected with the first sleeve knuckles to form a movable connection with the first wing plate, and the torque spring end working on the pivot. The torque adjusting unit includes a torque adjustment member which is movable inside the first sleeve, and also a spring on the torque adjustment member. The outer periphery of the torque adjustment member includes a second cam, and the second and first cams couple together as the torque adjustment member receives a resilient resistance force by the spring. A dent located at the outer edge of the torque adjustment member provides tools to drive the adjustment hole, as the other end of the torque spring works on the torque adjustment member to enable the torque adjustment member to rotate along a certain direction to move the coupled first cam and second cam to rotate in the opposite direction resulting in idle rotation.

The performance of the various embodiments of the invention herein use a torque spring of a torque providing unit, in which a torque adjustment member enables the torque spring to freely adjust the torque force. The design enables torque adjusting in a convenient manner.

Additional features and benefits of the present invention will become apparent from the detailed description, figures and claims set forth below.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

The previous description of the present invention and its other technological descriptions, characteristics and performances are described in detail with the drawings of a preferred embodiment.

Those of ordinary skills in the art will realize that the following detailed description of the embodiment of present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skills in the art having the benefit of this disclosure.

Figure 1:
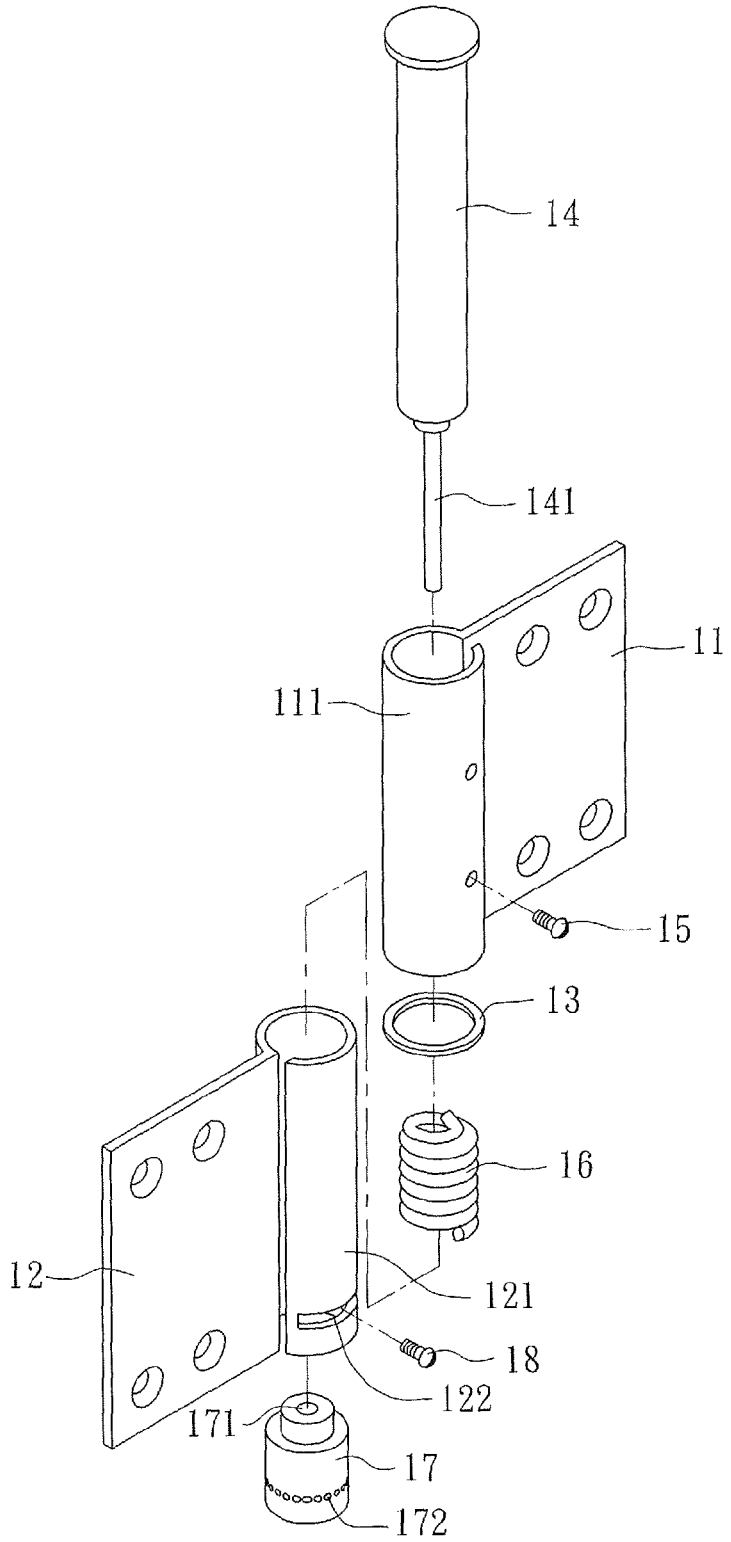
FIG. 1 PRIOR ART
FIG. 1 is an exploded view of a prior art hinge device.
Figure 2:
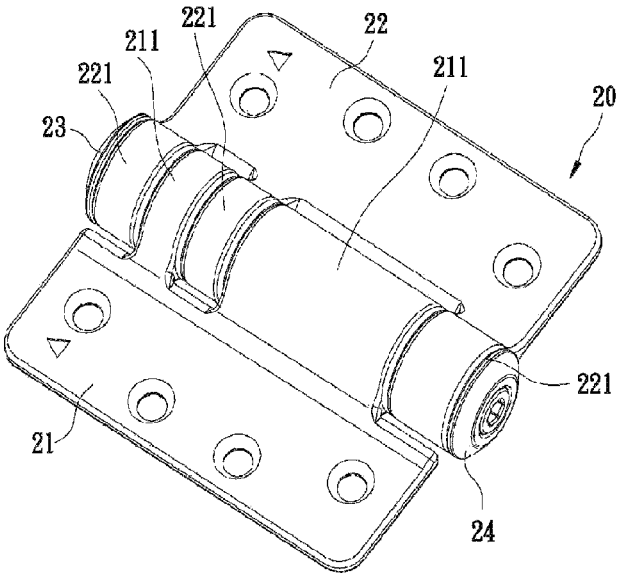
FIG. 2 is an elevation view of the adjustable torque hinge of the present invention in accordance with a preferred embodiment.
Figure 3:
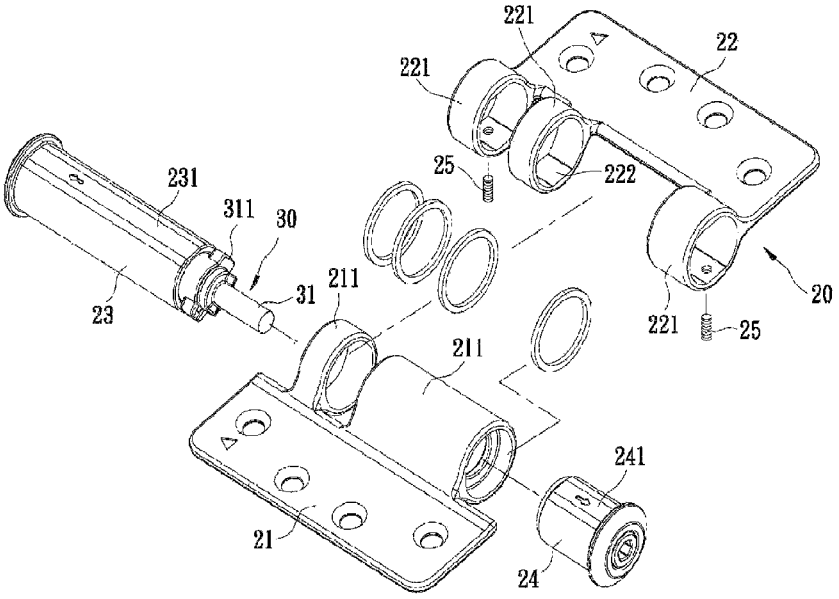
FIG. 3 is an exploded view of the above preferred embodiment.
Figure 4:
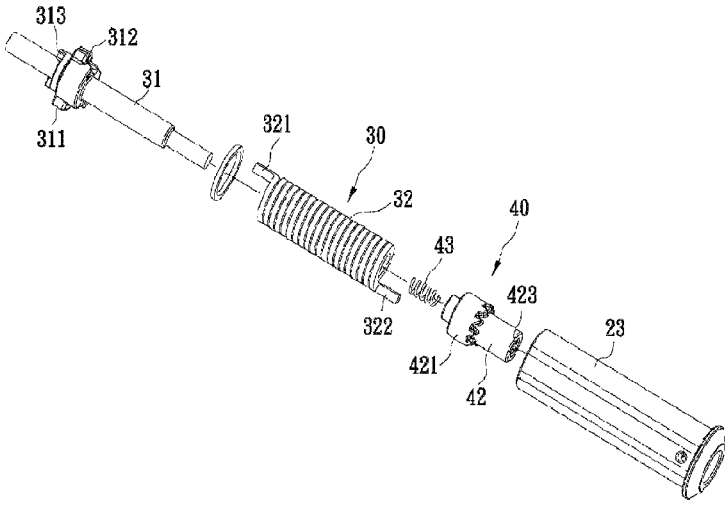
FIG. 4 is an exploded view of the above preferred embodiment.

Referring to FIGS. 2-4, an adjustable torque hinge of the invention herein is in accordance to a preferred embodiment, shown here particularly for use with door panels, and which comprises a hinge unit 20, a torque providing unit 30, a torque adjusting unit 40 and a speed adjusting unit 50. The shape and patterns of the members and assemblies in accordance to this embodiment are described in detail as follows.

The hinge unit 20 includes a first wing plate 21, a second wing plate 22, a first sleeve 23, a second sleeve 24 and two stop pins 25. The side of the first wing plate 21 includes small-sized and large-sized first sleeve knuckles 211 to couple with the three second sleeve knuckles 221 located on the side of the second wing plate 22. The inner wall of each of the second sleeve knuckles 221 includes two engaging members 222. The first sleeve 23 is inserted into the first sleeve knuckle 211 through the second sleeve knuckle 221 at one end of the second wing plate 22, and the second sleeve 24 is inserted into the first sleeve knuckle 211 through the second sleeve knuckle 221 at the other end of the second wing plate 22. The outer periphery of the first and second sleeves 23, 24 include two pin faces 231, 241 which couple with the engaging member 222. Two stop pins 25 are screwed into the outer peripheries of the first and second sleeves 23, 24 through the second sleeve knuckles 221; as such, the first and second sleeves 23, 24 are limitedly fixed within the second sleeve knuckles 221.

Figure 7:
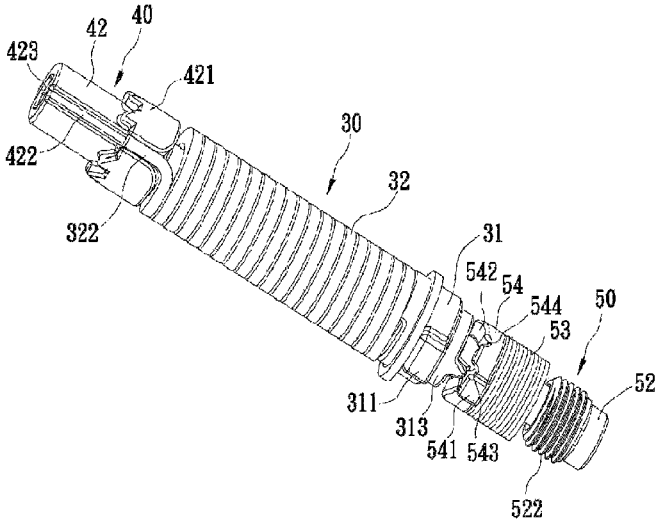
FIG. 7 is a perspective view of the above preferred embodiment.

Referring to FIGS. 4 and 7, the torque providing unit 30 includes a pivot 31 and a torque spring 32. The pivot 31 is movable and located within the first sleeve 23, and has a pair of angularly spaced-apart protrusions 311 protruding from a central portion of an outer periphery of the pivot 31. The protrusions 311 are mounted within the first sleeve knuckle 211 of the first wing plate 21 to form a movable connection between the pivot 31 and the first wing plate 21. The top edge of the protrusion 311 includes a slot 312, and the pivot 31 includes two symmetrical cam portions 313 at the sides of the protrusion 311. The two ends of the torque spring 32 respectively include a stand 321 and a second stand 322, and the stand 321 is inserted into the slot 312 of the pivot 31 to enable the torque spring 32 end work on the pivot 31.

Figure 5:
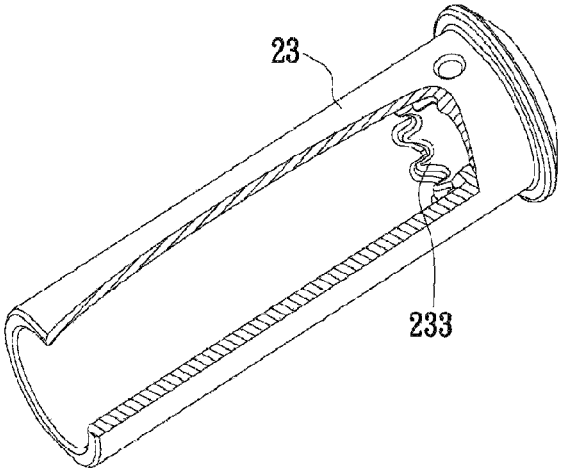
FIG. 5 is a cut-away view of the above preferred embodiment.
Figure 8:
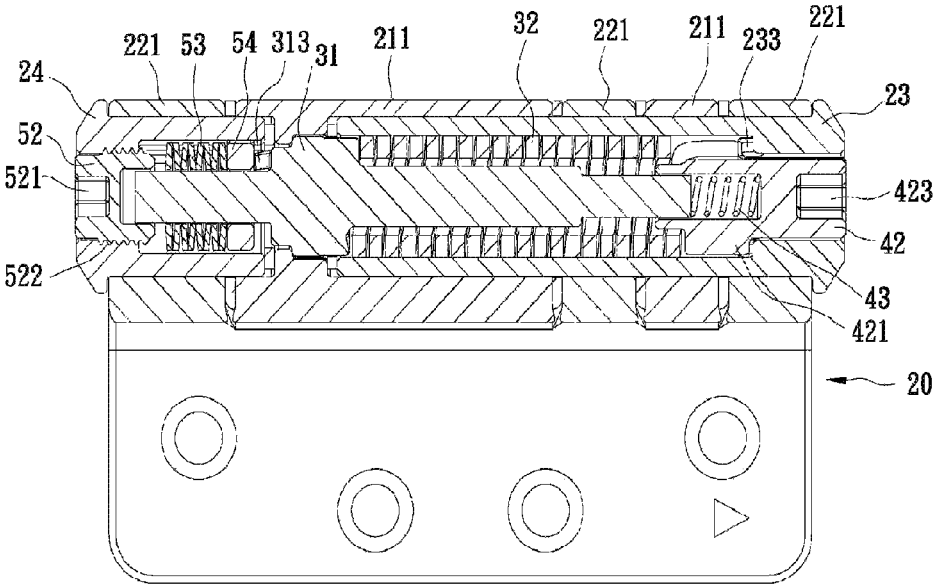
FIG. 8 is a cross-sectional view of the above preferred embodiment.

Referring to FIGS. 7 and 8, the torque adjusting unit 40 includes a torque adjustment member 42 and a spring 43. The first sleeve 23 includes a torque adjustment member 42, a spring 43, a torque spring 32 and inserted pivot 31 inside. The inside wall of the first sleeve 23 is surrounded with a gear-shaped first cam 233 (as shown in FIG. 5). The relative outer periphery of the torque adjustment member 42 includes a gear-shaped second cam 421 which couples with the first cam 233 as a movable combination. The edge of the outer periphery of the torque adjustment member 42 includes a slot 422 and the torque spring 32 includes a second stand 322 which is inserted to the slot 422, and allows the torque spring 32 to work towards the torque adjustment member 42. The outer end of the torque adjustment member 42 is exposed at the outer side of the first sleeve 23, and is formed with a indented hexagonal adjustment hole 423. The adjustment hole 423 allows permitted tools (for example, hex keys) to drive the torque adjustment member 42 and turn back the torque spring 32, and obtain a performance in adjusting the torque force. The inner side of the torque adjustment member 42 can be inserted with a spring 43, in which the spring 43 has a resilient resistance against the torque adjustment member 42 to maintain the second cam 421 and first cam 233 retain its geared-coupling to position the angular position of the torque adjustment member 42 after rotation. When the user presses the torque adjustment member 42 with force, the turn back effect of the torque spring 32 drives the torque adjustment member 42 to separate the second cam 421 with the first cam 233 to release the torque spring 32 back to its most relaxed status.

Figure 6:
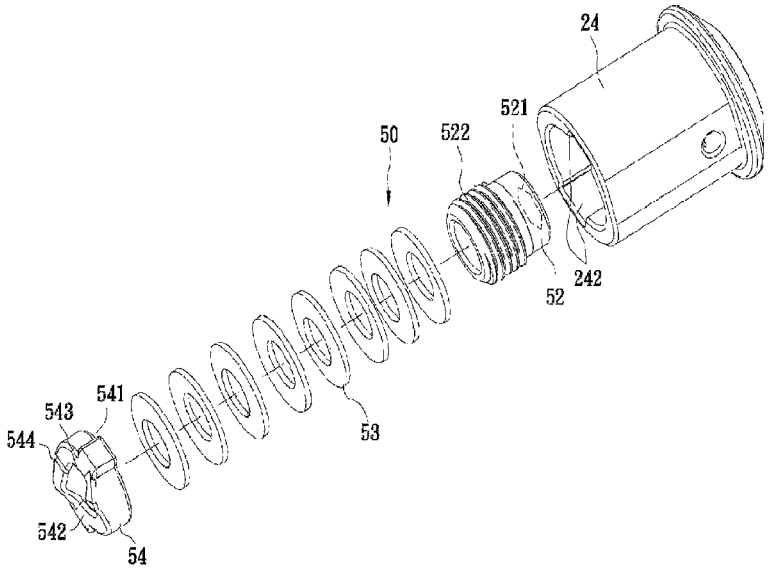
FIG. 6 is an exploded view of the above preferred embodiment.

Referring to FIGS. 6-8, the speed adjusting unit 50 comprises a speed adjustment member 52, several resilient members 53 and a cam 54. The speed adjustment member 52, resilient members 53 and cam 54 can be inserted inside the second sleeve 24. The outside of the speed adjustment member 52 includes a tool to insert and turn the adjustment hole 521. The outer periphery of the inner side includes a connected threaded segment 522 with the second sleeve 24. The outer periphery of the cam 54 includes two guide blocks 541 and two slide slots 242 at the inside wall of the second sleeve 24. The cam portion 313 facing towards the pivot 31 includes a cam face 542, wherein a locating slot 543 and second locating slot 544 is respectively located at the dent positions of the cam face 542 at appropriate angular positions. The cam 54 is resisted by the top of the cam portion 313 and moves toward the direction of the resilient member 53. The resilient member 53 then contacts with the cam member 54 to create a friction resistance towards the pivot 31 to control the rotary speed of the door panel. In this embodiment, the resilient member 53 includes several conical washers (or either can be replaced by compression springs). The thread rotation speed of the adjustment member 52 can change the size of the friction resistance of the resilient member 53 to the pivot 31. The mechanism enables adjustment of the rotary speed of the door panel.

The above gives a description of the various members and assembly patterns for the present invention of an adjustable torque hinge; the operational movements of the preferred embodiment of the present invention are further described as follow:

When the user opens a door panel installed with the preferred embodiment of the invention, the first and second wing plates 21, 22 will rotate counterclockwise relative to the first and second sleeve knuckles 211, 221. The rotational direction causes the first and second cams 233, 421 to couple with each other. At the very moment, the first cam 233 drives the second cam 421 to rotate, and further causes the turn back of the torque spring 32 to store energy.

After the door is opened, the first and second wing plates 21, 22 create a returning torque due to the energy stored within the torque spring 32. When nobody is operating the door, the door panel automatically produces a door shutting movement with the returning torque.

In one embodiment, a torque adjusting unit 40 adjusts the closing force of the door panel. The user first uses a tool (such as a hex key) to insert into the adjustment hole 423 of the torque adjustment member 42 and turn. As the torque adjustment member 42 drives the second cam 421 to rotate counterclockwise, the first cam 233 pushes back the second cam 421. At the same time the rotation of the second cam 421 presses the torque spring 32 to increase the torque. After the tool is released, the torque adjustment member 42 automatically makes the second cam 421 lock with the first cam 233 due to the resilient resistance provided by the spring 43. As a result, the torque spring 32 is positioned at the desired angular position and provides a suitable torque force.

In a general situation, if the first wing plate 21 is fixed onto a door panel, making the second wing plate 22 as the stationary plate, the pivot 31 in connection with the first wing plate 21 becomes the rotational bearing. As the first wing plate 21 rotates, the torque spring 32 uses the second stand 322 as pivot point and stand 321 rotates with the door panel to start accumulating pressure. Furthermore, if the first wing plate 21 is fixed to a door frame, in which the second wing plate 22 serves as the rotating plate, the first sleeve 23 and second sleeve 24 become the pivoted axle with the rotation of the second wing plate 22. The torque spring 32 applies stand 321 as the fixed pivot point, and the second stand 322 rotates with the door panel to start accumulating pressure. The embodiment of the present invention is able to accumulate pressure in both normal and reverse rotations, and thus the embodiment of the present invention is suitable for either left-opening or right-opening door panels and may use the same sets of hinge devices for installation purposes.

Figure 9:
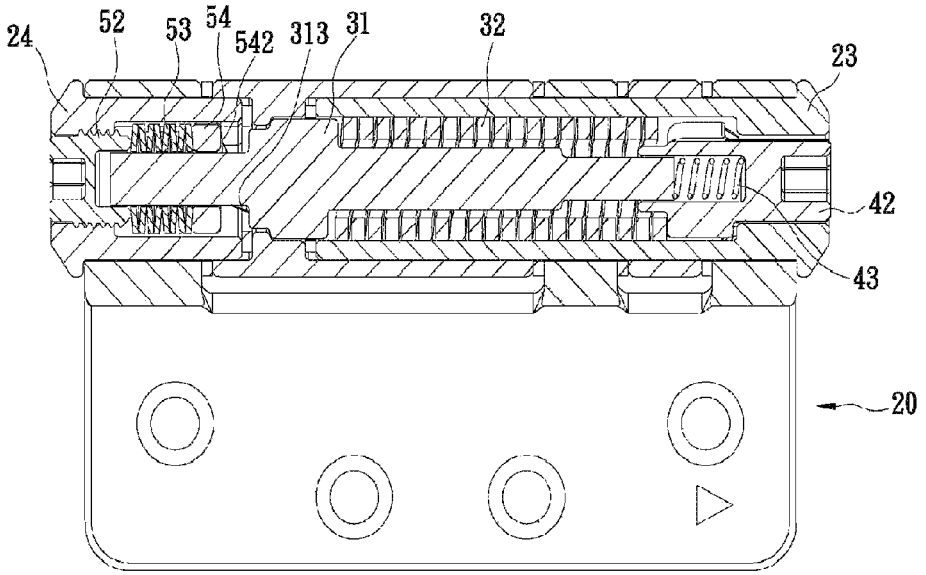
FIG. 9 is a cross-sectional view of the above preferred embodiment.
Figure 10:
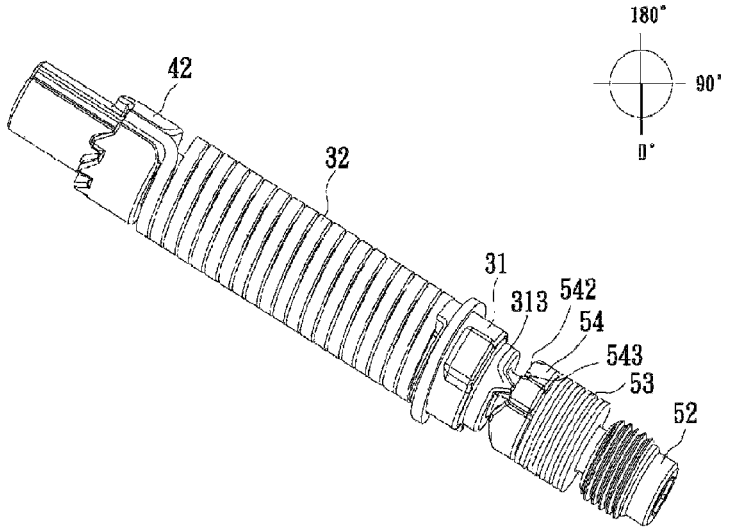
FIG. 10 is an actuation view of the above preferred embodiment (1)
Figure 11:
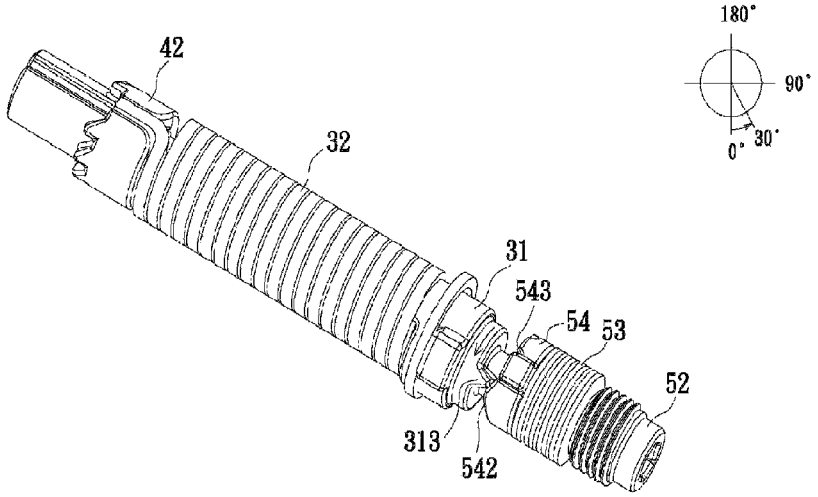
FIG. 11 is an actuation view of the above preferred embodiment (2)
Figure 12:
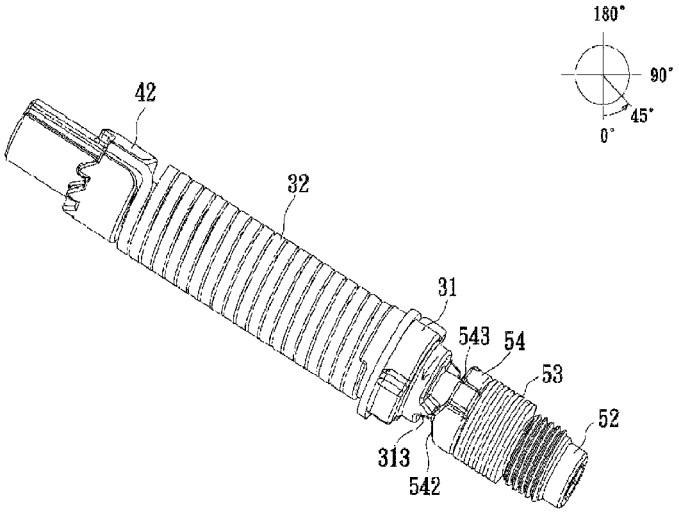
FIG. 12 is an actuation view of the above preferred embodiment (3).

Referring to FIG. 9, when the user gently pushes the door panel to close the door, the cam portion 313 of the pivot 31 moves with an angular direction with the cam face 542 of the cam member 54. The cam 54 presses against the resilient member 53 to produce a resistance to control the rotary speed of the door panel. Referring to FIG. 10, when the cam portion 313 begins to escape from the locating slot 543, the overall rotary speed of the door panel would appear faster as the inclination contact with the cam member 54 is rather leveled and has less friction resistance to the pivot 31. When the door panel is opened between 0 to 10 degrees, the friction force is least (nearly no friction), and the door panel would use its fastest speed for door-shutting operations. Referring to FIGS. 11 and 12, when the rotational angle of the door panel is between 30 to 45 degrees, the inclination between the cam face 542 of the cam member 54 and cam portion 313 of the pivot 31 is steeper, also with the addition of the resilient resistance of the resilient member 53 against the cam member 54, the friction resistance toward the pivot 31 becomes larger and the door panel will close with a slower speed.

Further referring to FIG. 7, when the user pushes the door panel to open the door, when the opening angle of the door panel reaches a suitable angle, the cam 54 receives a resilient resistance from the resilient member 53 and the above locating slot 543 or second locating slot 544 will lock the cam portion 313 on the pivot 31. The door panel is opened to a certain angle and fixed, ceasing any closing effects.

The present adjustable torque hinge solves the using problems of the prior art hinge device 10. The technological means and advantages of the embodiment of the present invention include the following:

(1). Produces an automatically opened and closed operation: The embodiment of the present invention uses a torque spring 32 of a torque providing unit 30, to provides a constant output torque force to the first and second wing plates 21, 22 to enable the door panel perform an automatic door-shutting effect.

(2). Controllable rotation force: The torque adjusting unit 40 of the embodiment of the present invention can insert a toot to turn the torque adjustment member 42 to drive and change the torque value of the torque spring 32, which is used to control the torque force upon the door panel. The adjusting operation is fast and convenient. In addition, the torque adjustment member 42 has a 360-degree rotation; the tightness of the torque spring 32 is not limited by the angle, as the user can arbitrarily adjust the torque spring 32 to produce a suitable torque.

(3). Controllable rotary speed: The embodiment of the present invention includes a speed adjusting unit 50 to adjust the rotary speed of the door panel. The speed adjusting unit 50 includes a resilient member 53 which creates a brake damper effect for the speed adjustment member 52. This slows the pivotal rotation of the door panel to avoid strong collisions of the door panel with the door frame. Furthermore, the user only needs to use a tool with the speed adjustment member 52 for adjusting purposes. The operations of speed control are both quite fast and convenient.

(4). Smooth rotation: During the door opening rotation process, the two wing plates 21, 22 of the embodiment of the present invention applies the pin joint combination between the first and second sleeves 23, 24 with the first sleeve knuckles 211 and second sleeve knuckles 221 to block the loading influence to the inside members. As a result the two wing plates 21, 22 rotate smoothly.

The above description is only for the preferred embodiment of the present invention, and should not be limited to the scope of the present invention. Any simple equivalent changes or modifications within the scope of the present invention and description remain to be within the scope of this invention. The hinge device can be broadly applied, such as doors, windows, cabinet doors, notebooks, mops. and other movable connections.

The claimed invention is:

1. An adjustable torque hinge comprising:

a hinge unit having a first wing plate, a second wing plate, a first sleeve and a second sleeve, said first wing plate including first sleeve knuckles, said second wing plate including second sleeve knuckles, said first and second sleeve knuckles being coupled together, said first sleeve being sleeved in said first and second sleeve knuckles, an outer periphery of the first sleeve connected co-movably to said second sleeve knuckles, said first sleeve provided with a first cam therein, wherein said outer periphery of said first sleeve includes an engaging surface fitted in said second sleeve knuckles, and wherein said hinge unit further includes a stop pin extending through one of said second sleeve knuckles to fix said first sleeve relative to said second sleeve knuckles;

a torque providing unit having a movable pivot extending through said first and second sleeve knuckles, and a torque spring sleeved on said pivot, an outer periphery of said pivot being connected co-movably to said first sleeve knuckles of said first wing plate, said torque spring having a first end working on said pivot; and a torque adjusting unit having a movable torque adjustment member set within said first sleeve, and a spring disposed on said torque adjustment member, said torque adjustment member having an outer periphery that is provided with a second cam, said spring biasing resiliently said torque adjustment member to couple said second cam to said first cam, an outer end of said torque adjustment member being formed with an adjustment hole for a driving operation of a tool, said torque spring further having a second end that works on said torque adjustment member such that when said torque adjustment member rotates in a direction, said first cam and said second cam are coupled to each other to be co-rotatable and when said torque adjustment member rotates in another direction, said first cam and second cam are uncoupled to rotate in an opposite direction resulting in idle rotation.

2. The adjustable torque hinge according to claim 1, wherein said outer periphery of said pivot includes a protrusion mounted inside one of said first sleeve knuckles, and wherein said protrusion has a slot for insertion of said first end of said torque spring.

3. The adjustable torque hinge according to claim 1, further comprising a speed adjusting unit including a speed adjustment member that is threadedly disposed within said second sleeve, a resilient member that is disposed in said second sleeve and that is able to be pressed by said speed adjustment member, and a cam member that is disposed movably in said second sleeve and that is able to be pressed by said resilient member.

4. The adjustable torque hinge according to claim 3, wherein said pivot includes a cam portion, said cam member being biased by said resilient member to contact said cam member so as to generate a resisting force.

5. The adjustable torque hinge according to claim 4, wherein said cam member is formed with a locating slot for insertion of said cam portion at a predetermined angular position.

* * * * *